United States Patent [19]

Darone et al.

[11] Patent Number: 4,742,870

[45] Date of Patent: May 10, 1988

[54] HEAT EXCHANGER

[75] Inventors: Thomas G. Darone, Reston, Va.; Robert W. Langley, Westminster, Colo.

[73] Assignee: Cobe Laboratories, Lakewood, Colo.

[21] Appl. No.: 924,605

[22] Filed: Oct. 29, 1986

[51] Int. Cl.[4] ..... F28D 7/02

[52] U.S. Cl. ..... 165/164; 165/170

[58] Field of Search ..... 165/164, 170

[56] References Cited

U.S. PATENT DOCUMENTS

| | | | |
|---|---|---|---|
| 1,313,730 | 8/1919 | Pease | 165/166 |
| 1,966,133 | 7/1939 | Pieper | 165/164 X |
| 2,947,152 | 8/1960 | Bloem | 165/164 X |
| 4,577,683 | 3/1986 | Kelch | 165/164 |

FOREIGN PATENT DOCUMENTS

| | | | |
|---|---|---|---|
| 418961 | 3/1923 | Fed. Rep. of Germany | 165/164 |
| 630450 | 12/1927 | France | 165/164 |

*Primary Examiner*—Ira S. Lazarus
*Assistant Examiner*—Peggy Neil

[57] ABSTRACT

A heat exchanger useful for example in medical applications has a plurality of parallel abutting channels separated by a sheet through which heat is exchanged, with the channel-defining walls preferably in line contact with the sheet and with sharp changes in direction rendering a generally serpentine flow pattern in each channel.

11 Claims, 3 Drawing Sheets

HEAT EXCHANGER

FIELD OF THE INVENTION

This invention relates to heat exchangers, and more particularly to such devices useful in clinical equipment such as dialysis machines.

BACKGROUND OF THE INVENTION

Prior art heat exchangers for using spent dialysate to heat incoming fresh water have been characterized by a single serpentine flow path in each of two molded plastic portions separated by a thin layer of sheet steel through which heat transfer occurred.

SUMMARY OF THE INVENTION

We have discovered that an improved such heat exchanger may be provided by substituting for a single flow path through the heat exchanger, on each side of the sealing heat transfer sheet, a plurality of such flow paths, or channels, to provide for parallel flow therethrough, adequate heat transfer being given by limiting the length of flow path straightaways relative to flow path hydraulic diameter so as to produce in flow paths non-equilibrium laminar flow.

There is thus made possible greater heat transfer efficiency, smaller heat exchanger size, lower pressure drop, and simplicity of manufacture.

In preferred embodiments, channel cross-sectional shapes are pointed, with pointed portions pointing toward each other and pressed against the heat transfer sheet; each channel is serpentine, with a maximum L/D (straightaway length to hydraulic diameter ratio) of about 3; and each heat exchanger portion contains fourteen channels.

PREFERRED EMBODIMENT

We now describe the preferred embodiment of the invention, its structure and operation, in conjunction with the attached drawings.

DRAWINGS

STRUCTURE

Figure 1:
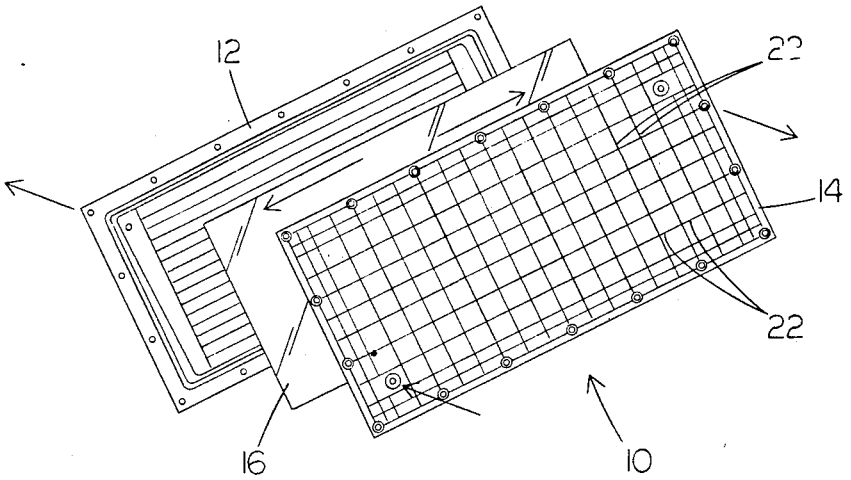
FIG. 1 is an exploded, somewhat diagrammatic view of said embodiment.

There is shown in FIG. 1 an exploded view of a heat exchanger indicated generally at 10, showing the inner side of a first portion 12, the outer side of an identical second portion 14, and divider 16.

Portions 12, 14 are each a unitary plastic molding (identical, but facing) provided therearound with a flange 18, a housing section 20 carrying outwardly an integral therewith grid of thin structural ribs 22, and inlet and outlet members 24, 26. A groove 28 generally rectangular in cross-section and also in general configuration (although with rounded corners, the groove being equidistant from the periphery of the heat exchanger therearound except where thus rounded) in each heat exchanger portion 12, 14 carries therein correspondingly overall configured round in cross-section O-ring 30.

Held between O-rings 30, compressed owing to forces imposed by bolts extending through holes 32 into sealing relationship therearound therewith, is sheet 16.

Along each end of each heat exchanger portion is defined a manifold 34.

Figure 5:
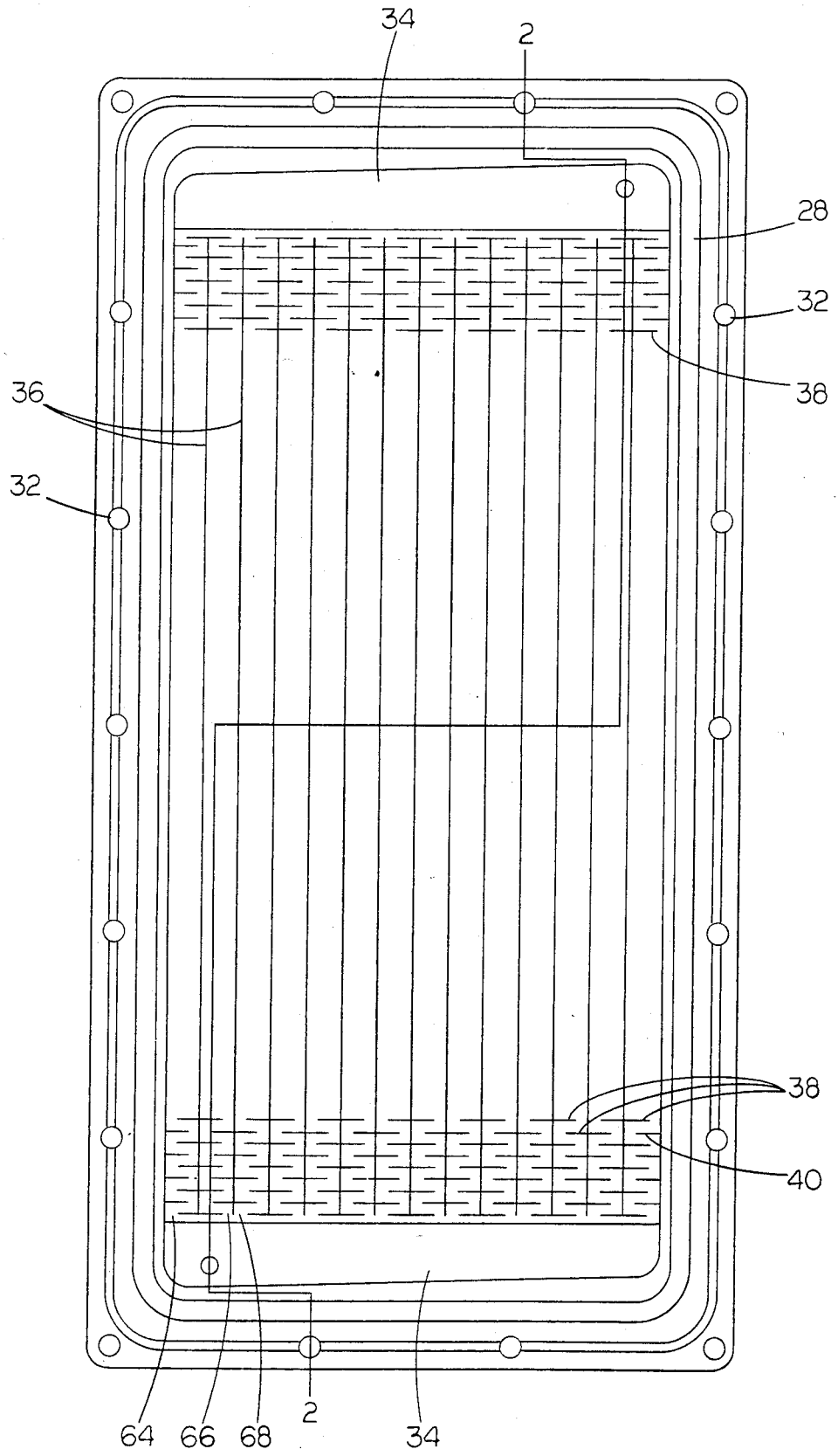
FIG. 5 is a diagrammatic plan view of the entire one portion shown partially in FIG. 3.

Indicated diagrammatically in FIG. 5 are the fourteen parallel channels of each portion of the heat exchanger, the vertical lines 36 being the apices of the cross-sections of the boundaries, which are triangular in such cross-sections, the apices being in sealing contact with divider 16. Each horizontal line 38 indicates an apex along which a channel wall, triangular in cross-section, engages metal divider sheet 16 to define therewith adjacent walls of two channels.

Figure 3:
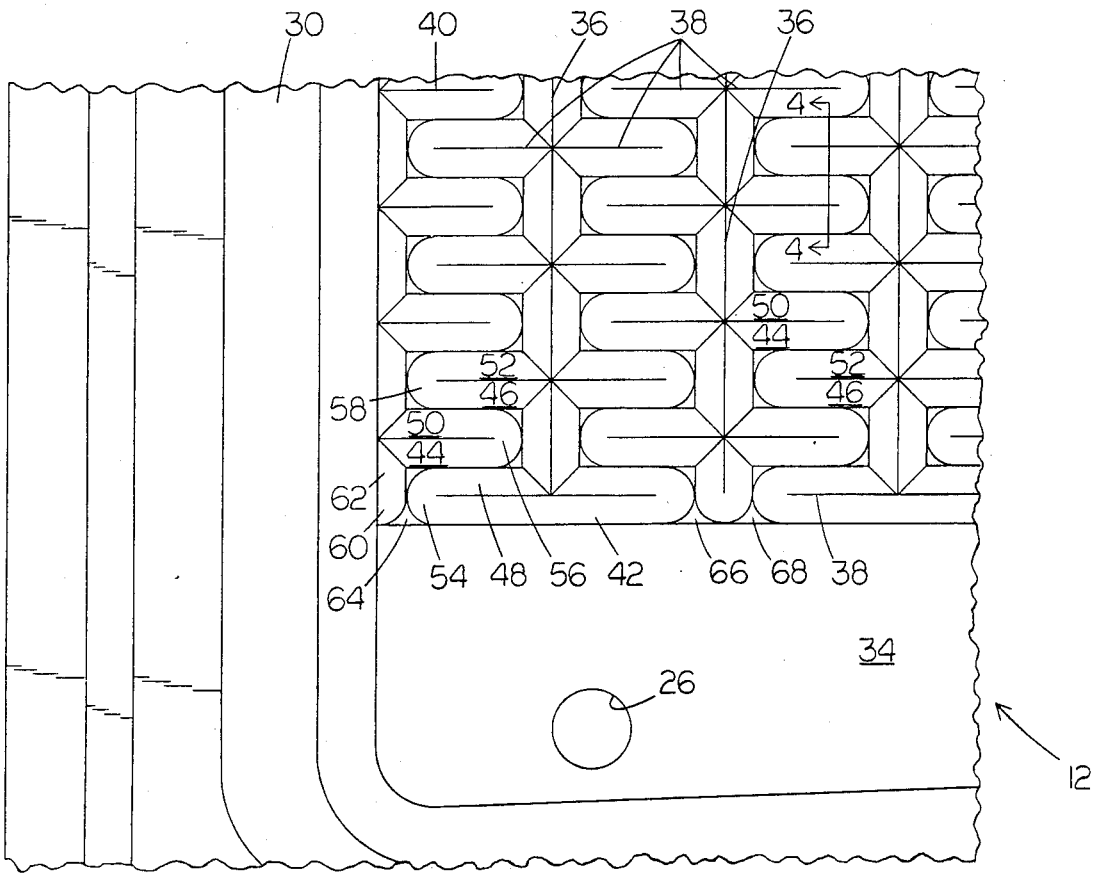
FIG. 3 is a partial plan view of one portion of said embodiment, looking in a direction away from the dividing metal sheet.
Figure 2:
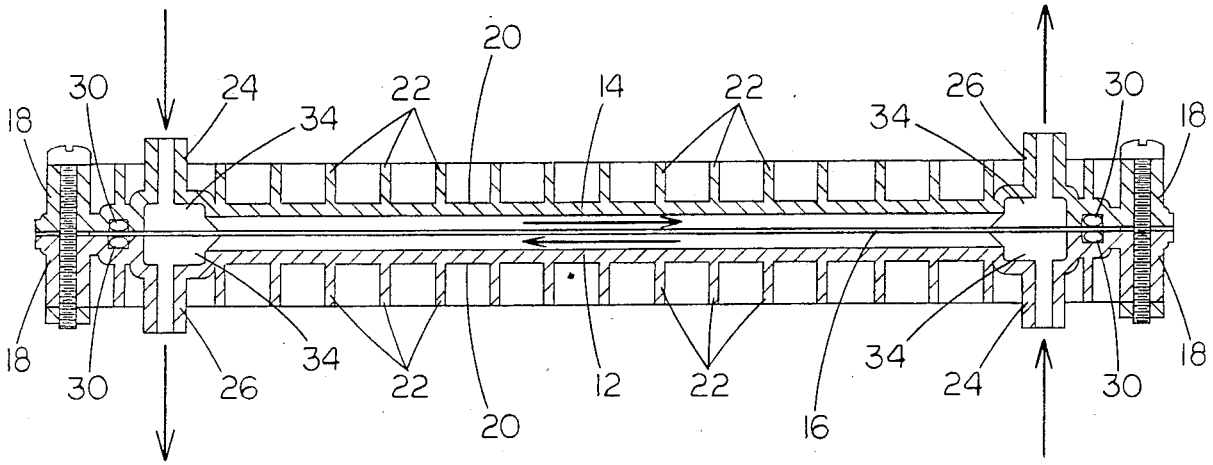
FIG. 2 is a sectional view, taken for bottom portion 12 at 2—2 of FIG. 5, and for top portion 14 along a section similarly passing through two screws and two conduits.
Figure 4:
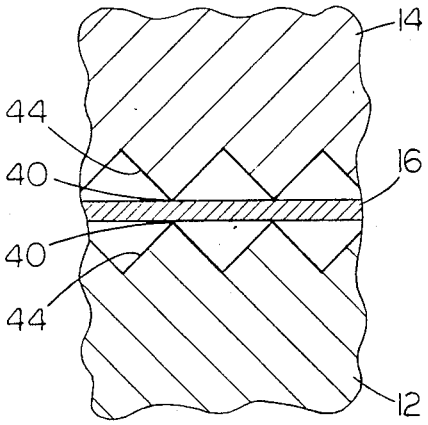
FIG. 4 is a partial cross-sectional view at 4—4 of FIG. 3, but showing also the abutting other portion and the intervening metal sheet.
Figure 6:
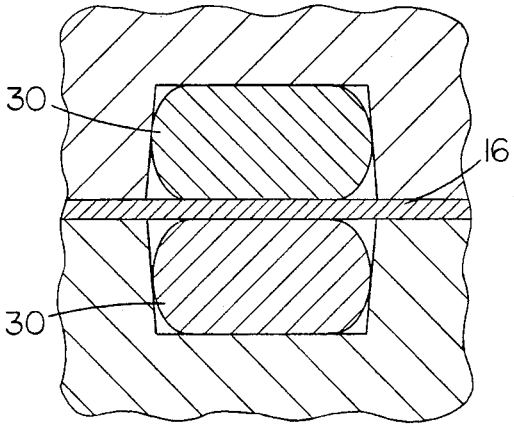
FIG. 6 is a partial cross-sectional view showing abutting O-rings with the metal sheet between them.

The configuration of these walls is more particularly shown in FIG. 3. There is shown, in one corner of one portion of the heat exchanger, a portion of about three and a half of the fourteen channels. The vertical lines 36 and the horizontal lines 38 (and 40) are here seen fleshed out with more structural detail. Sloping downwardly from the crests 38 in both a thickness and a longitudinal direction are planar surfaces 42, 44, 46. Sloping downwardly from the crests 38 in a thickness direction but upwardly (in the drawing) in a longitudinal direction are planar surfaces 48, 50, 52. Joining surfaces 42, 44, 46 respectively with surfaces 48, 50, 52 are 180° frustoconical surfaces 54, 56, 58. Opposite surface 54 is 90° frustoconical surface 60, and planar surface 62. All surfaces slope downwardly in a thickness direction. Openings 64, 66, 68 allow movement of liquid from manifold 34 into each of the fourteen serpentine channels, going longitudinally in a serpentine fashion between divider 20 and portion 12. Apices abut apices throughout portions 12 and 14.

The longest straightaways provided in the channels are in a transverse direction, and are the distances between the beginnings of the frustoconical portions (e.g., 54 and 56), the beginning of a frustoconical portion providing a disruption inconsistent with the settling into equilibrium laminar flow. The hydraulic diameter of the triangular passages is 0.42 times their base length; and L/D is about 3.

The figures are drawn to proportion but not exactly to scale; the distance between lines 36 defining channels is in fact about 3/8 inches. The L/D ratio could be larger than 3, e.g., no more than 4 .

OPERATION

Through the 14 channels on one side of divider 16, in parallel flow from an upper (FIG. 5) manifold 34 to a lower manifold 34, passes spent, warm dialysate. On the other side of divider 16, in opposite net longitudinal flow direction, passes fresh, cooler dialysate.

Because pressures in each side-by-side channel are the same at corresponding places along their length, channel to channel short circuiting is avoided—as well as made of little importance even if possible. Because of the serpentine configurations used, as above described, good heat transfer, with over 70% efficiency, results for low flow velocities. Because of low flow velocities, total cross-sectional flow channel area is increased over prior art devices with one serpentine channel on each side of a divider, diminished pressure drops and flow rates are practical. Because contact between channel walls and divider is essentially line rather than area, effective heat transfer surface is conserved and heat transfer improved for the same size.

What is claimed is:

1. A heat exchanger comprising a first section, a second section, and a divider, said first section and said second section being in liquid-sealing juxtaposition with said divider, and said first section and said second section including wall portions having extremities contacting said divider and relieved portions between corresponding wall portions so as to define each with said divider a corresponding plurality of flow passages, each said flow passage extending from one end of said exchanger to the other, said flow passages including a plurality of straightaway portions and nonstraight portions, the ratio of a length, L, of straightaway portions of said flow passages between said nonstraight portions to a hydraulic diameter, D, of the flow area being no more than 4.

2. The heat exchanger of claim 1 in which said corresponding plurality is a corresponding multiplicity.

3. The heat exchanger of claim 1 in which said multiplicity is 14.

4. The heat exchanger of claim 2 in which said flow passages are defined between each of said first section and said second section and said divider in substantially line contact.

5. The heat exchanger of claim 4 in which said flow passages are triangular in cross section.

6. The heat exchanger of claim 2 in which said flow passages include many abrupt changes in direction.

7. The heat exchanger of claim 6 in which said flow passages are serpentine.

8. The heat exchanger of claim 2 in which said sections are identical in configuration.

9. The heat exchanger of claim 2 in which the highest L/D is no more than 4.

10. The heat exchanger of claim 9 in which no L/D is greater than about 3.

11. The heat exchanger of claim 5 in which said passages are equilaterally triangular.

* * * * *